United States Patent [19]

Rosier

[11] Patent Number: 4,615,206

[45] Date of Patent: Oct. 7, 1986

[54] OFFSET TOOL AND CARTRIDGE NOSE ASSEMBLY

[75] Inventor: Hendrik E. Rosier, Kingston, N.Y.

[73] Assignee: Huck Manufacturing Company, Irvine, Calif.

[21] Appl. No.: 718,404

[22] Filed: Apr. 1, 1985

[51] Int. Cl.[4] ..... B21D 31/00

[52] U.S. Cl. ..... 72/391; 72/453.17

[58] Field of Search ..... 72/391, 453.17, 453.19; 29/243.53

[56] References Cited

U.S. PATENT DOCUMENTS

| | | | |
|---|---|---|---|
| 3,374,656 | 3/1968 | Di Maio | 72/391 |
| 3,475,945 | 11/1969 | Chirco | 72/391 |
| 3,593,401 | 7/1971 | Chirco | 29/252 |
| 3,605,478 | 9/1971 | Chirco | 72/391 |

*Primary Examiner*—Francis S. Husar
*Assistant Examiner*—David B. Jones
*Attorney, Agent, or Firm*—Harness, Dickey & Pierce

[57] ABSTRACT

A hand tool for setting multipieced fasteners such as lock bolts by application of a relative axial force and being fluid actuated by a piston-cylinder actuable along a first axis and having a removable cartridge type nose assembly for applying the axial setting force to the fastener along a second axis radially offset from the first axis such that the area immediately behind the nose assembly is essentially open and with the tool having a handle to be gripped by the operator and with a portion of the tool including the nose assembly being selectively rotatable about the first axis to facilitate use of the tool in various installation situations.

7 Claims, 5 Drawing Figures

OFFSET TOOL AND CARTRIDGE NOSE ASSEMBLY

SUMMARY—BACKGROUND OF THE INVENTION

The present invention relates to apparatus for setting multipieced fasteners, such as lock bolts including a pin and a collar, by the application of a relative axial force between interacting pieces.

Multipieced fasteners such as lock bolts, are conventionally applied by tools having a pull piston and cylinder construction and which are pneumatically or hydraulically actuated with the axis of the pull piston being generally in line with the axis of the fastener, i.e. the pin and collar for a lock bolt type fastener. Often it is necessary or desirable to install such fasteners in situations where there is a limited clearance in which to apply the tool to the fastener. For such situations tools were utilized such as that shown in the U.S. Pat. No. 3,593,401 for Eccentric Tool issued July 20, 1971 to Chirco. With such a tool, however, the anvil and jaw assemblies which acted on the fastener to apply the relative axial force were an integral part of the tool. The anvil and jaw assembly, being more highly stressed than most of the other tool components, were more susceptible to wear or damage. However, in the event of wear or damage to these parts, the tool would have to be dismantled and significant portions of the tool would have to be replaced. In addition, since the anvil and jaw assembly were so closely integrated with the remainder of the tool a different tool would have to be provided for each fastener of a different diameter or configuration. Also with regard to the Chirco tool as such, the anvil and jaw assembly were substantially fixed relative to the remainder of the tool such that rotation between the anvil and jaw assembly and the remainder of the tool would not occur. Such rotation, however, is desirable in some applications leading to the flexibility and versatility of the tool. Another type of offset tool is depicted in U.S. Pat. No. 3,197,840 for Clearance Attachment Tool issued Aug. 3, 1965 to Van Hecke. Note that the latter tool has only a limited clearance relative to its anvil and jaw assemblies. Also see U.S. Pat. No. 3,534,580 for Eccentric Riveting Tool issued Oct. 20, 1970 to Chirco and U.S. Pat. No. 3,475,945 for Clearance Tool Assembly issued Nov. 4, 1969 to Chirco.

In the present invention an offset tool is provided in which the anvil and jaw assembly are in a cartridge form of nose assembly, separate and readily removable from the remainder of the tool. Thus replacement of the nose assembly is facilitated for repair purposes and/or to permit use of the tool for fasteners of different diameters and/or different configurations. In addition, the portion of the offset tool cooperating with the anvil and jaw assembly, i.e. nose assembly, can be rotated relative to the remainder of the tool whereby the flexibility of the tool is enhanced.

While separate, removable cartridge type nose assemblies have been commonly used with the conventional in-line type of tools, the cartridge form of the present invention is uniquely combined with the offset tool of the present invention. Examples of such prior nose assemblies for in-line tools can be seen in U.S. Pat. No. 3,107,806 for Modified Nose Assembly issued Oct. 22, 1963 to Van Hecke et al and U.S. Pat. No. 3,605,478 for Integral Anvil Holder issued Sept. 20, 1971 to Chirco.

Therefore it is an object of the present invention to provide an offset tool of the above described type in which the anvil and jaw assembly are in a separate readily removable cartridge form of nose assembly.

it is another object of the present invention to provide an offset tool in which the fastener setting portion of the tool i.e. including the cartridge form of nose assembly is rotatable relative to the remainder of the tool whereby the flexibility of the tool is enhanced.

It is still another object of the present invention to provide a unique cartridge type nose assembly for use with the offset tool of the present invention.

It is a general object of the present invention to provide a unique offset tool for setting multipieced fasteners by the application of a relative axial force between fastener components.

Other objects, features, and advantages of the present invention will become apparent from the subsequent description and the appended claims, taken in conjunction with the accompanying drawings, in which:

Figures 1, 2:
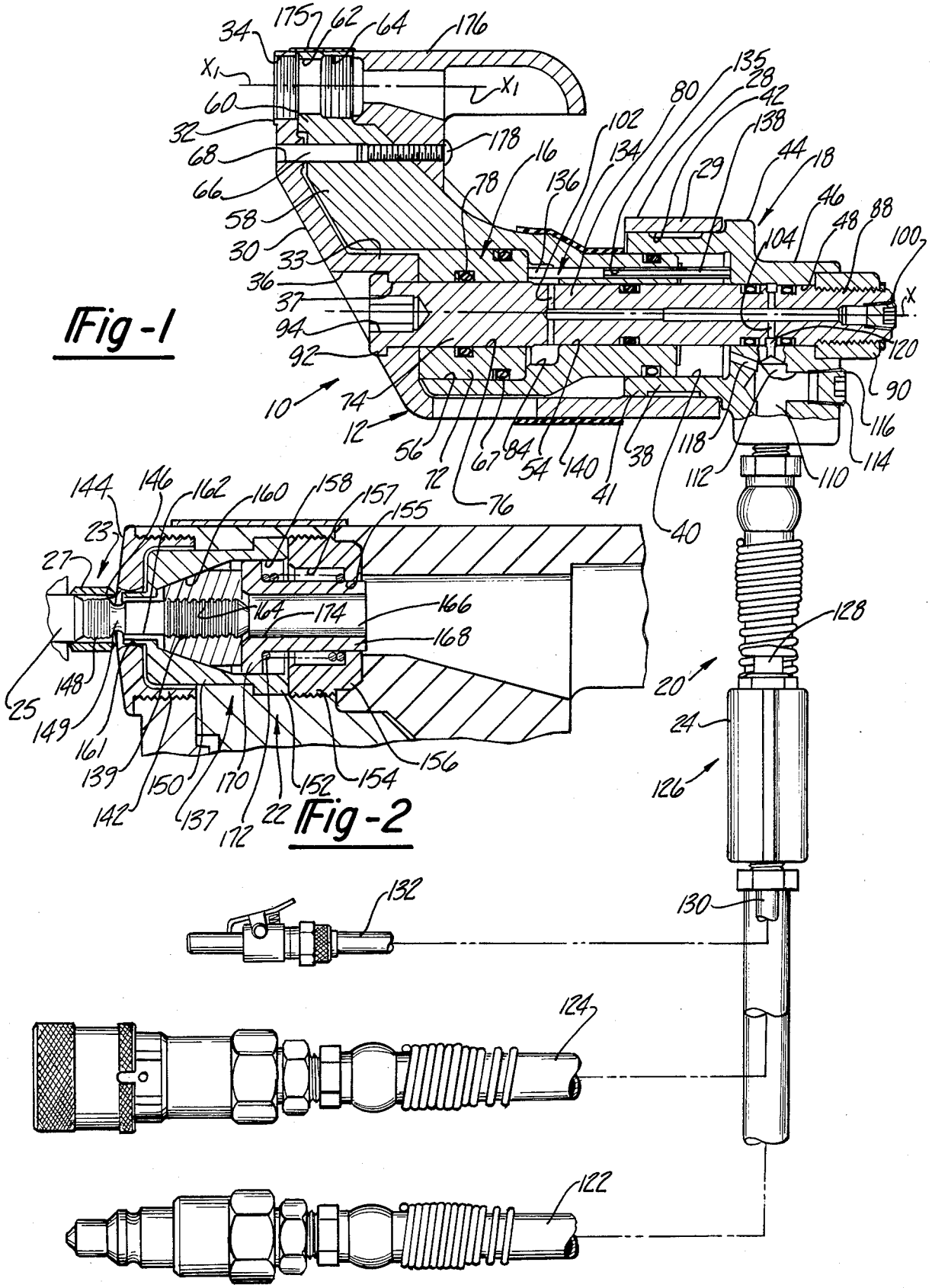
FIG. 1 is an elevational view, with some parts shown in section, of an offset tool embodying features of the present invention.
FIG. 2 is an enlarged fragmentary view of the cartridge type nose assembly and adjacent portion of the offset tool of FIG. 1 in assembly relationship with a lockbolt to be set.

Looking now to the drawings, an offset tool assembly 10 includes a housing 12, a collet 14, a piston 16, an end adaptor 18 and a fluid power line and trigger assembly 20. The tool assembly 10 is adapted to cooperate with a removable, cartridge type nose assembly 22 (see FIG. 2). As will be seen in greater detail, the collet 14 is adapted to reciprocate relative to the remainder of the tool assembly 10 whereby the desired relative axial force can be applied to the fastener (such as fastener 23, FIG. 2). At the same time the housing 12 and collet 14, along with the nose assembly 22 can be rotated relative to the piston 16, the end adaptor 18 and the power line assembly 20. Since a portion 24 of the power line assembly 20 near the end adaptor 18 functions as a handle section to be gripped by the operator, the noted rotation facilitates the positioning of the nose assembly 22 relative to the handle section 24 enhancing the flexibility of the tool assembly 10 to accommodate various fastener installation conditions.

Fasteners which can be installed by the tool assembly 10 can be of the general type shown in U.S. Pat. No. 2,531,048 for Fastening Device issued Nov. 21, 1950 to L. C. Huck or U.S. Pat. No. 4,472,096 for Optimized Fastener Construction System and Method issued Sept. 18, 1984 to Ruhl et al. One such fastener 23 is shown in FIG. 2 in assembly relationship to the nose assembly 22 with the fastener 23 including a pin 25 and a collar 27 adapted to be swaged onto the pin in response to the noted relative axial force.

Figure 3:
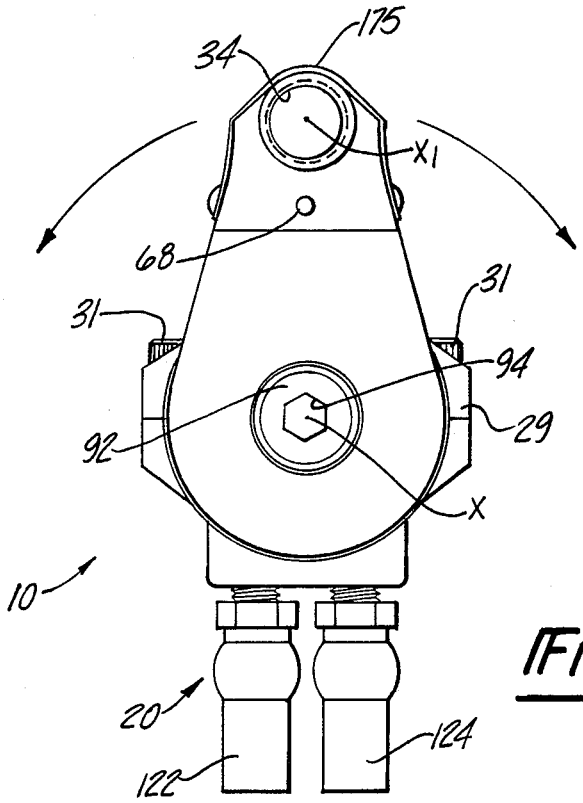
FIG. 3 is an end view of the offset tool of FIG. 1.
Figure 4:
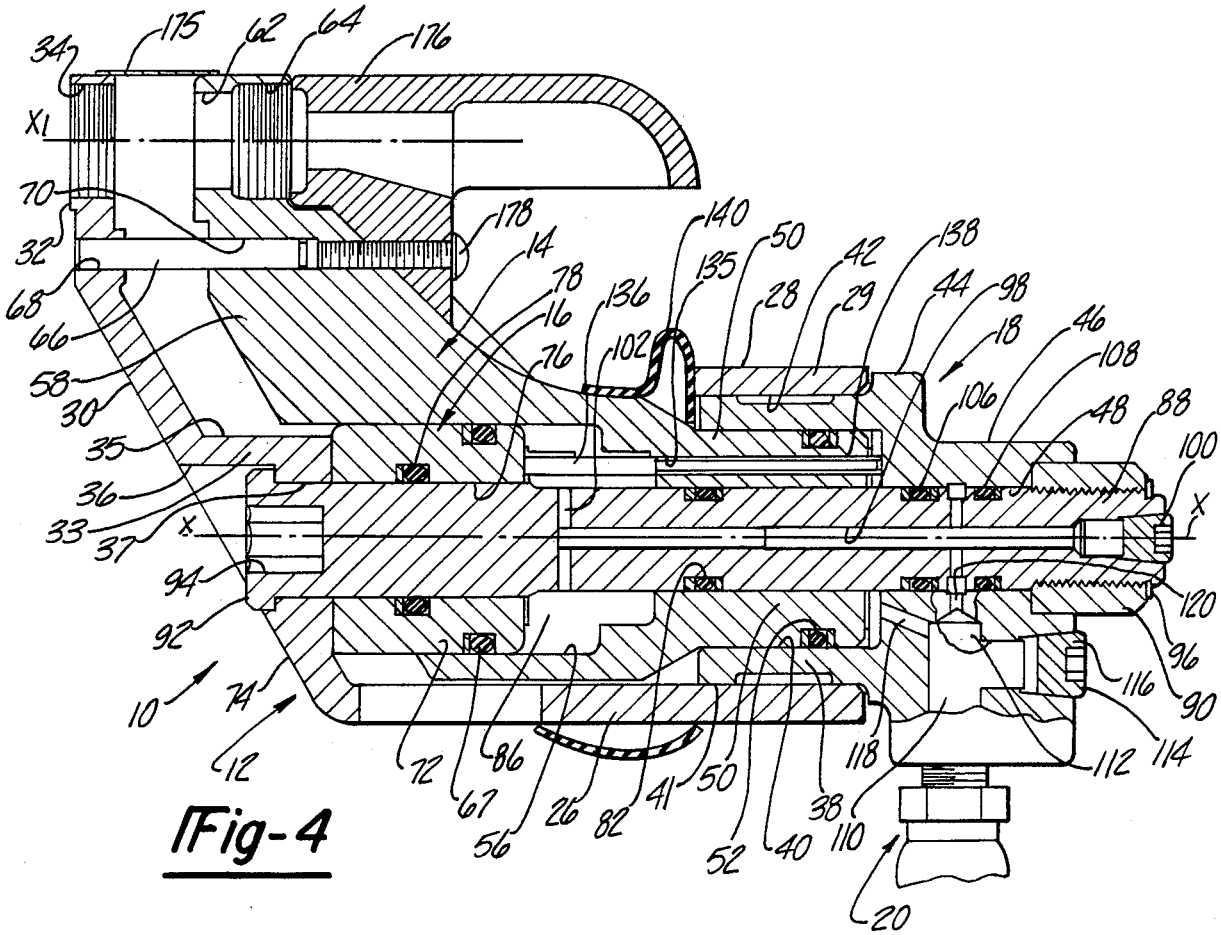
FIG. 4 is an enlarged elevational view, with some parts shown in section, of the offset tool of FIG. 1 with the tool shown in its fastener setting condition.
Figure 5:
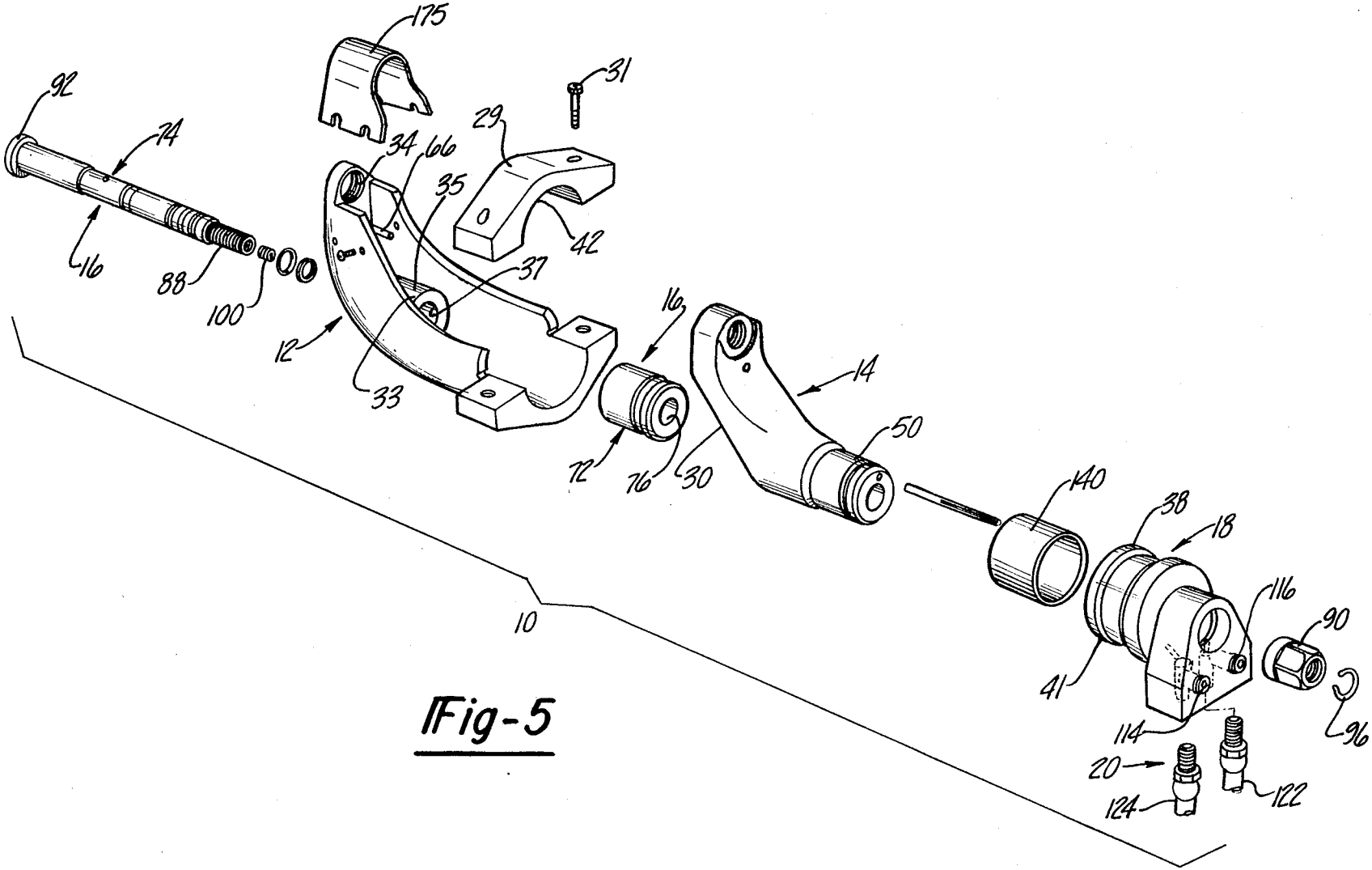
FIG. 5 is an exploded view of the tool of FIGS. 1–4.

The housing 12 has a generally semi-circularly formed base portion 26 which terminates at its rearward end in a flanged end portion 29 (see FIGS. 3 and 4); a circular, ring portion 28 is defined by an end cap 29 which has flanges secured to the mating flanges of flanged end portion via a pair of threaded fasteners 31 (see FIGS. 1, 3, and 4). The ring portion 28 has a bore 42 having a central axis X. A generally channel shaped forward portion 30 extends upwardly and is inclined forwardly relative to the base portion 26 and the axis X. Forward portion 30 terminates in an upper portion 32 which extends generally transversely relative to the axis X. A threaded anvil bore 34 is located in the upper portion 32 and has an axis XI which is parallel to and in the same plane as axis X.

A generally rearwardly, interiorly extending shoulder portion 33 connects base portion 26 and the inclined forward portion 30. The upper surface 35 of shoulder portion 33 is generally circular and an enlarged bore 36, and reduced diameter bore 37 extend through shoulder portion 33 and are coaxial with axis X.

The end adaptor 18 has an annular cylinder portion 38 which has a bore defining a return cylinder cavity 40; the outer surface 41 of end adaptor 18 has a pair of axially spaced flanges adapted to be received within bore portion 42 of the housing ring portion 28 with a relatively snug, sliding fit. The adaptor cylinder portion 38 terminates at its rearward end in an enlarged diameter shoulder portion 44 which acts as an axial stop against the confronting rearward end surface of the ring portion 28. The end adaptor 18 has a rearward end portion 46 with a reduced diameter end bore 48 which is coaxial with the return cylinder cavity 40. Thus the end adaptor 18 is slidingly and hence rotatingly supported within bore 42 of the housing ring portion 28.

The collet 14 at its rearward end, has a generally circularly shaped piston portion 50 which is adapted to slidingly fit within the return cylinder cavity 40; an annular seal assembly 52 provides a fluid seal between the forward end of the return cylinder cavity 40 and the collet piston portion 50. The forward end of the collet 14 is generally shaped to match the confronting, interior contour of the base portion 26 and forward portion 30 of the housing 12. Thus the collet 14 has a coaxial pair of stepped bores 54 and 56 with the forward end of the larger diameter bore 56 and the collet 14 being contoured to generally match that of the housing shoulder portion 33. An upwardly extending, inclined forward portion 58 of the collet 14 terminates in a transversely extending upper portion 60 which has coaxial, stepped jaw bores 62 and 64 adapted to be located in coaxial alignment with the housing anvil bore 34, i.e. along axis XI.

As will be seen the collet 14 is adapted to axially reciprocate relative to the housing 12. The collet 14 is slidably supported at its rearward end via the collet piston portion 50 in housing return cavity 40 and, as will be seen, at its forward end via piston 16. A locating and guide pin 66 is located in aligned bores 68 and 70 in the upper housing portion 32 and upper collet portion 60, respectively. The pin 66 locates and guides the collet 14 relative to the housing 12 such that the coaxial alignment between anvil boer 34 and stepped jaw bores 62 and 64. The pin 66 also aids in maintaining alignment by resisting relative rotation between the collet 14 and the housing 12.

As noted the collet 14 is slidably supported proximate its forward end on piston 16. Piston 16 includes an annular piston head 72 being of an outside diameter to snugly fit within enlarged collet bore 56 and against the housing shoulder 33; a seal assembly 67 provides a seal between the piston head 72 and collet bore 56. A separate piston rod 74 extends through the small shoulder bore 37 and a through bore 76 in the piston head 66. A seal assembly 78 provides a fluid seal between the piston head bore 76 and the piston rod 74. A reduced diameter portion 80 of the piston rod 74 is snugly, slidingly received in the small collet bore 54 with a seal assembly 82 providing a seal therebetween. Thus the forward end of the collet 14 is slidably supported on piston head 72 and its rearward end is also slidably supported on the confronting portion of the piston rod 74.

The collet 14 has an intermediate bore 84 located between collet bores 54 and 56. As will be seen the collet intermediate bore 84 and an adjacent portion of the large collet base 56 define a pull cylinder cavity 86, whereby the collet assembly 14 can be reciprocated relative to the piston 16 in response to fluid pressure in pull cavity 86.

The piston rod portion 80 extends through the reduced diameter end adaptor bore 48 and terminates outwardly therefrom in a reduced diameter threaded end portion 88. A retaining nut 90 is threadably secured to the piston rod threaded end portion 88 and is located partially within a counterbore at the end of end adaptor bore 48. The piston rod 74 has an enlarged head 92 at its opposite end which is adapted to be located within the enlarged bore 36 in the housing shoulder portion 33. A hex shaped blind bore 94 (Allen head type) is located at the same end and facilitates the threaded securement of the retaining nut 90 to the opposite, threaded rod end 88. Thus when retaining nut 90 is tightened it will hold the stop shoulder portion 44 of end adaptor 18 against the confronting end of the housing ring portion 28 and will also hold the piston 16 in place while permitting the collet 14 to reciprocate. A snap type retaining ring 96 precludes the above assembly from loosening and coming apart.

The piston rod 74 provides fluid passage means to appropriately communicate a source of fluid pressure to the pull cavity 86.

Thus the piston rod 74 has a fluid passageway 98 defined by an axially extending bore which is blocked at its outer end by plug 100. The passageway 98 communicates with the pull cavity 86 via a radial cross port 102, and communicates with the end adaptor small bore 48 via a radial cross port 104. The small bore 48 and piston rod 74 are sealed at opposite sides of cross port 104 via seal assemblies 106 and 108.

The end adaptor 18 has a pair of laterally spaced compound bores 110 and 112 which are blocked at their axial ends via plugs 114 and 116, respectively. An inclined, generally axially extending cross bore 118 communicates the return cylinder cavity 40 with the end adaptor bore 110 while a radial bore 120 communicates the pull cylinder cavity 86 with the end adaptor bore 112 via cross port 102, fluid passageway 98 and cross port 104.

Fluid pressure to actuate the tool is communicated from a source of fluid pressure (not shown) via the power line assembly 20. Thus a first fluid line 122 is adapted to connect the pull cylinder cavity 86 to the source of fluid pressure while a second fluid line 124 is adapted to connect the return cylinder cavity 40 to the source of fluid pressure. A trigger assembly 126 includes a push button trigger switch 128 located adjacent to the handle section 24 and can control the application of fluid pressure from the source by a signal transmitted via line 130 and connector 132. The trigger assembly 126, the fluid source and the elements controlling the fluid source via the trigger assembly 126 are elements well known to those skilled in the art; the details thereof do not constitute a part of the present invention and hence have been omitted for purposes of simplicity.

Thus when the trigger switch 128 is actuated, high pressure fluid is communicated to line 122 while line 124 is connected to low pressure tank or return. This results in fluid pressure being applied to the pull cylinder cavity 86 whereby the collet 14 will be moved rearwardly towards the position shown in FIG. 3. At the same time the fluid in return cylinder cavity 40 is returned to tank via line 124. After the fastener (such as fastener 23 of FIG. 2) has been set by the application of the relative axial force resulting from the movement of collet 14, the operator can return the tool assembly 10 to its original condition by simply releasing the trigger switch 128. Now the fluid line 124 is connected to fluid under pressure while the fluid line 122 is connected to return or tank. In this condition, fluid pressure will be transmitted to the return cylinder cavity 40 while the pull cylinder cavity 86 will be connected to tank. Now, the collet 14 will be moved forwardly to the return position shown in FIG. 1.

In order to avoid the prolonged application of high fluid pressure during the pull stroke after the fastener (such as fastener 23) has been set, i.e. the operator maintains the trigger switch 128 depressed, a relief valve is provided to relieve the fluid pressure at the end of the pull or installation stroke. The relief valve includes an elongated pin 134 located in a radially offset, axially extending through bore 135 in the collet piston portion 50. The pin 134 is generally of a length to extend from the piston head 72 to the end wall of return cylinder cavity 40. The pin 134 has one end 136 at the pull cylinder cavity 86 which is of a diameter to block fluid through the relief bore 135; but a series of flats at the opposite end 138 provide a passage with bore 135. The flats are located such that communication through the bore 135 and around the flat portion 138 of the pin 134 will occur only when the collet 14 has substantially moved to its final rearward position after setting the fastener (such as fastener 23).

A flexible annular guard 140 is located over the collet 14 and around the housing base portion 26 to generally block the forward opening of the return cylinder bore 40 to prevent ingress of foreign materials during reciprocation of the collet 14.

As noted one of the advantages of the present invention is the use of a readily removable nose assembly such as nose assembly 22. The nose assembly 22 is of a cartridge type and is especially useful for lockbolt type fasteners made of exotic materials such as titanium since the disposable pin tail portion of the pin 25 of the fastener 23 can be reduced to a minimum length.

Looking now to FIG. 2, the nose assembly 22 includes a swage anvil insert 142 and a jaw assembly 137. The anvil insert 142 has an axially extending annular attachment flange 142 which has external threads for being threadably engaged in the housing anvil bore 34. The anvil insert 142 has a generally enlarged, low profile outer cap portion 144 which is adapted to overengage the surface of upper body portion 32 surrounding the anvil bore 34. The anvil insert 142 has a central swage cavity 146 which can be contoured pursuant to the Ruhl et al patent (supra) to effectively swage the lockbolt collar 27 on to the pin 25.

The swaging action is accomplished by a relative axial force with the pin 25 being gripped at a pull groove portion 13 by the jaw assembly 137 and pulled with the pulling force resisted by the anvil insert 142 via the swage cavity 146 against the collar 27; upon the attainment of a relative axial force of a predetermined magnitude the swage cavity 146 will move axially over the collar 27 swaging it radially inwardly into lock grooves 148 in the pin 25. After completion of swaging, the axial force continues to increase until the pin 25 severs at a breakneck groove 149.

The jaw assembly 137 has a tubular housing 150 of a cylindrical shape of a generally uniform outside diameter but which terminates at its rearward end in an enlarged diameter flange 152. Thus the tubular housing 150 is of a diameter to fit snugly in the reduced diameter collet bore 62 with the flange 152 located in the larger bore 64 and engaging the shoulder defined between the two bores 62, 64.

An annular retaining nut 154 is externally threaded for threaded engagement in the threaded portion of the enlarged collet bore 64; the rearward end surface 156 of the nut 154 can be hex shaped to facilitate gripping by a wrench and tightening. Thus the retaining nut 154 holds the jaw housing 150 securely in place. The nut 154 has a through bore 155 which leads to a counter bore 157 at its inner end.

The housing 150 has an enlarged bore 158 at its rearward end which communicates at its inner, forward end in a frusto-conically shaped bore 160. The jaw housing 150 terminates at its forward end in an axially protruding, reduced diameter ejector nose 161 which is of an outside diameter to move into the swage cavity 146 in a clearance relationship. The ejector nose 161 has a reduced diameter bore 162 which communicates with the frusto-conical or tapered bore 160. A plurality of separate gripping jaws 164 (preferably three in number) are located in the jaw housing 150 and have a portion of their outer surfaces conically shaped to generally match the contour of the tapered bore 160. A jaw follower 166 has a tubular portion 168 adapted to be slidably supported in the retaining nut bore 155 and has an increased diameter head portion 170 slidably located in the enlarged jaw housing bore 158 in a clearance relationship. The head portion 170 is urged into engagement with the rearward end surface of the gripping jaws 165 by a spring 172. Thus the jaws 164 are normally urged forwardly to a closed position. The jaw follower 166 has a through bore 174 generally of the same diameter as the ejector nose bore 162. With the collet 14 in its forwardmost position as shown in FIG. 2 the ejector nose 161 will extend partially into the swage cavity 146 to a position proximate its smallest diameter.

In operation, a pull groove portion 139 of the fastener pin 25 is inserted into the jaw assembly 137; the gripping jaws 164 are moved rearwardly (against the jaw follower 166 and the light pressure of spring 172) and radially outwardly to permit the grooves in pin pull portion 139 to be gripped by comlementary teeth on the jaws 164. The collar 27 is engaged by the anvil insert 142. The operator actuates the tool by depressing the trigger switch 128 applying fluid pressure to the pull cavity 86 causing the collet 14 and hence jaw assembly 137 to be moved rearwardly from the anvil insert 142. As the application of relative axial force continues to increase the swage anvil cavity 146 swages the collar 27 radially into pin lock grooves 148. The axial force increases until the pin 25 fractures at a breakneck groove 149. The operator releases the trigger switch 128 and the collet 14 is moved forwardly by fluid pressure applied to the return cylinder cavity 40. This moves the jaw assembly 137 forwardly moving the ejector nose 161 against the end of swaged collar 27 forcing the collar 27 out of the cavity 146 and freeing the tool assembly 10 for the next fastener installation.

It may be desirable to provide a means to deflect the severed portion of the pin 25 as it is ejected rearwardly from the jaw assembly 140. Thus a pin tail deflector 176 can be secured to the collet 14 via a bolt 178 in a threaded portion of alignment bore 68 whereby the ejected pin tail portion will be deflected downwardly away from the tool operator. A shield 78 is secured to the upper end portion 32 of housing 12 and extends over the upper end portion 60 of collet 14 to prevent material or the operator from being pinched between the collet 14 and housing 12 at that location.

Note that while the rear adaptor 18 is being held stationary by the operator the remainder of the tool assembly 10 including the housing 12, collet 14, and associated nose assembly 22 can be rotated (see FIG. 3) about the piston 16 and hence about the axis X. This lends versatility to the tool assembly 10 permitting it to be used in different close clearance situations.

Note that the cartridge type of nose assembly 22 also lends greater flexibility to the tool assembly 10 both in repair and maintenance and in the variety of fastener types to be handled. Thus in the event the swage anvil insert 142 is worn, it is a relatively inexpensive procedure to simply replace the insert 142 without the need to dismantle the remainder of the tool assembly 10 or the jaw assembly 137. Similarly, in the event of a jaw malfunction, it is a quick and simple matter to replace only the jaw assembly 137 while leaving the anvil insert 139 and the remainder of the tool assembly 10 intact.

At the same time the tool assembly 10, per se, could be used to drive other fasteners by simply changing the nose assembly 22. Thus the nose assembly 22 is especially adapted for use with fasteners such as fastener 23 having a reduced length of pintail; this permits for a significant cost saving when the pin 25 is made of an exotic, expensive material such as titanium. In this regard note that the axial length of the swage cavity 146 (and hence thickness of the anvil insert 142) is just sufficient to effectuate the desired swage while permitting adequate structural support to withstand the swage loads. At the same time, the jaw assembly 137 is constructed to locate the jaws 164 as close to the swage anvil cavity 146 as possible; this permits the pin 25 to have a minimum length of the pull portion 139 which is just sufficient to facilitate gripping by the jaws 164. For more conventional lock bolt constructions it may be desirable to utilize a more conventional nose assembly generally constructed in the manner shown in the U.S. Pat. No. 4,347,728 for Apparatus and System for Setting Fasteners issued Sept. 7, 1982 to Smith. In the latter case, the nose assembly would be considerably longer than nose assembly 22 but would be secured to the housing 12 and collet 14 in the manner shown with regard to nose assembly 22.

It should be noted that a significant radial offset can be provided between the axis XI of fastener installation X and the piston axis X. Also the embodiment shows the area behind the nose assembly 22 (and hence fastener to be applied) is completely clear and hence permits the tool assembly 10 to be used in application where clearance is severely limited.

Note that the anvil insert 142 is substantially flush with the confronting portion of the housing upper portion 32 permitting the anvil insert 142 to be of a minimum thickness or length. This factor plus the close proximity of the gripping jaws 164 permits the disposable pintail portion of the pin 25 to be minimized which is especially beneficial where exotic materials are employed.

Thus a unique tool construction is shown in which the axis of operation of the nose assembly can be considerably radially offset from the axis of the actuating piston-cylinder combination permitting its use in close clearance situation. The tool lends itself to the use of a unique cartridge type nose assembly which provides versatility to the tool in maintenance and in the variety of fasteners that can be accommodated. The nose assembly 22 and associated components can be rotated relative to the remainder of the tool permitting flexibility in different fastener installation situations.

While it will be apparent that the preferred embodiments of the invention disclosed as well calculated to fulfill the objects above stated, it will be appreciated that the invention is susceptible to modification, variation and change without departing from the proper scope or fair meaning of the invention.

What is claimed is:

1. An installation tool selectively operable from a source of fluid pressure for setting multipieced fasteners by the application of a relative axial force between interacting fastener components, said installation tool comprising:

a housing member having a forward and a rearward end, said housing member having an elongated base portion terminating at its rearward end in a ring portion, said ring portion being defined by an end cap removably secured to said housing member at said rearward end and the confronting portion of said rearward end, said ring portion defining a bore having a generally circular inner surface having a first axis, said housing member terminating at its opposite end in a generally channel shaped portion extending generally transversely and forwardly inclined relative to said first axis and said rearward end, said channel portion having an inwardly extending shoulder portion proximate to the forward end of said base portion and pair of outer and inner stepped shoulder bores through said shoulder portion with the axis of said shoulder bores being coaxial with said first axis, said outer one of said shoulder bores being larger than said inner one of said shoulder bores, said channel portion terminating at its upper end in a portion extending generally in quadrature with said first axis, said upper end having a threaded anvil bore having a second axis which is radially offset from but parallel to said first axis, a rear adaptor member having a cylindrical portion with axially spaced radially extending shoulders rotatably located in said ring portion bore and having a bore defining a return cylinder cavity, the axis of said cylindrical portion including said return cylinder cavity being coaxial with said first axis, said adaptor member having an end portion extending rearwardly from said cylindrical portion and defining an enlarged stop shoulder engageable with the confronting end of said base ring portion to axially locate said cylindrical portion at a preselected position within said base ring portion, said adaptor member having a reduced diameter end bore extending through said adaptor end portion and, coaxially with said first axis from said return cylinder cavity, a piston comprising an annular piston head having a central bore and a piston rod slidably located in said piston head central bore, said piston rod extending coaxially with said first axis and having an enlarged head portion located in said enlarged shoulder bore and having a rod portion extending in clearance through said return cylinder cavity and generally in sliding engagement through said adaptor reduced diameter end bore, a collet member having a rearwardly extending piston portion slidably, rotatably located within said return cavity, said collet member having a first support bore extending generally coextensively with said collet piston portion and being slidably supported upon said rod portion of said piston rod, said collet member having an enlarged support bore at its opposite, forward end which is coaxial with said first support bore and with said enlarged support bore being slidably supported upon said piston head, an intermediate sized bore located between and connecting said first and second support bores and defining in part a pull cylinder cavity, said collet member having a forward portion extending transversely upwardly from and inclined relatively to said first axis and being contoured generally complementarily with the inner surface contour of said housing member channel portion, said collet member forward portion terminating at its upper end in a portion extending generally in quadrature to said first axis and having a jaw support bore located coaxially with said anvil bore along said second axis, said collet member adapted to reciprocate along said first and second axes rearwardly in response to fluid pressure applied to said pull cylinder cavity and forwardly in response to fluid pressure applied to said return cylinder cavity, said piston rod portion terminating at its rearward end in a threaded portion extending outwardly from said adaptor end bore, a threaded nut member matably threaded onto said piston rod threaded portion to clamp said enlarged stop shoulder of said adaptor member against said base ring portion, said piston rod portion having an axially extending fluid path and a first radial cross bore communicating said axial fluid path with said pull cylinder cavity, and a second radial cross bore located generally in said adaptor end portion, said adaptor member having first fluid path means communicating with said return cylinder cavity, said adaptor member having a second fluid path means communicating with said second cross bore and hence with said pull cylinder cavity via said axial fluid path and said first cross bore, fluid connecting means for connecting said first and second fluid path means to the source of fluid pressure and including a handle member, a nose assembly for installing the fastener in response to reciprocable movement of said collet member, said nose assembly including an anvil member removably, threadably secured in said housing member anvil bore, said nose assembly including a jaw assembly having a housing with a shoulder portion located within said collet jaw bore and a nut member threadably engaged in a portion of said collet jaw bore to clamp said nose assembly to said collet, said nose assembly including a plurality of gripping jaw members adapted to grip one of the components of the fastener with said anvil adapted to engage another of the components whereby the fastener will be installed in response to the rearward reciprocal movement of said collet, said housing member, said collet and said nose assembly being selectively rotatable relative to said piston and about said first axis.

2. The installation tool of claim 1 with said anvil member having a low profile enlarged flange providing a substantially flush line with said housing upper end and having a swage cavity of a preselected minimum width whereby a fastener with a minimum length pin can be installed.

3. An installation tool selectively operable from a source of fluid pressure for setting multipieced fasteners by the application of a relative axial force between interacting fastener components, said installation tool comprising:

a housing member having a forward and a rearward end, said housing member having an elongated base portion terminating at its rearward end in a ring portion, said ring portion being defined by an end cap removably secured to said housing member at said rearward end and the confronting portion of said rearward end, said ring portion defining a bore having a generally circular inner surface having a first axis, said housing member terminating at its opposite end in a generally channel shaped portion extending generally transversely relative to said first axis and said rearward end, said channel portion having an inwardly extending shoulder portion proximate to the forward end of said base portion and pair of outer and inner stepped shoulder bores through said shoulder portion with the axis of said shoulder bores being coaxial with said first axis, said outer one of said shoulder bores being larger than said inner one of said shoulder bores, said channel portion terminating at its upper end in a portion having a threaded anvil bore having a second axis which is radially offset from but parallel to said first axis, a rear adaptor member having a cylindrical portion rotatably located in said ring portion bore and having a bore defining a return cylinder cavity, the axis of said cylindrical portion including said return cylinder cavity being coaxial with said first axis, said adaptor member having an end portion extending rearwardly from said cylindrical portion and defining an enlarged stop shoulder engageable with the confronting end of said base ring portion to axially locate said cylindrical portion at a preselected position within said base ring portion, said adaptor member having a reduced diameter end bore extending through said adaptor end portion and, coaxially with said first axis from said return cylinder cavity, a piston comprising an annular piston head having a central bore and a piston rod slidably located in said piston head central bore, said piston rod extending coaxially with said first axis and having an enlarged head portion located in said enlarged shoulder bore and having a rod portion extending in clearance through said return cylinder cavity and generally in sliding engagement through said adaptor reduced diameter end bore, a collet member having a rearwardly extending piston portion slidably, rotatably located within said return cavity, said collet member having a first support bore extending generally coextensively with said collet piston portion and being slidably supported upon said rod portion of said piston rod, said collet member having an enlarged support bore at its opposite, forward end which is coaxial with said first support bore and with said enlarged support bore being slidably supported upon said piston head, said collet member having a pull cylinder cavity operative with said piston head, said collet member having a forward portion extending transversely upwardly from said first axis, said collet member forward portion terminating at its upper end with a jaw support bore located coaxially with said anvil bore along said second axis, said collet member adapted to reciprocate along said first and second axes rearwardly in response to fluid pressure applied to said pull cylinder cavity and forwardly in response to fluid pressure applied to said return cylinder cavity, said piston rod portion terminating at its rearward end in a fastener portion extending outwardly from said adaptor end bore, a fastener member secured to said piston rod fastener portion to clamp said enlarged stop shoulder of said adaptor member against said base ring portion, said piston rod portion having an axially extending fluid path and a first radial cross bore communicating said axial fluid path with said pull cylinder cavity, and a second radial cross bore located generally in said adaptor end portion, said adaptor member having first fluid path means communicating with said return cylinder cavity, said adaptor member having a second fluid path means communicating with said second cross bore and hence with said pull cylinder cavity via said axial fluid path and said first cross bore, fluid connecting means for connecting said first and second fluid path means to the source of fluid pressure and including a handle member, a nose assembly for installing the fastener in response to reciprocable movement of said collet member, said nose assembly including an anvil member removably secured in said housing member anvil bore, said nose assembly including a jaw assembly having a housing with a shoulder portion located within said collet jaw bore and a second fastener member engaged in a portion of said collet jaw bore to clamp said nose assembly to said collet, said nose assembly including a plurality of gripping jaw members adapted to grip one of the components of the fastener with said anvil adapted to engage another of the components whereby the fastener will be installed in response to the rearward reciprocal movement of said collet, said housing member, said collet and said nose assembly being selectively rotatable relative to said piston and about said first axis.

4. An installation tool selectively operable from a source of fluid pressure for setting multipieced fasteners by the application of a relative axial force between interacting fastener components, said installation tool comprising:

a housing member having a forward and a rearward end, said housing member having an elongated base portion terminating at its rearward end in a ring portion, said ring portion being defined by an end cap removably secured to said housing member at said rearward end and the confronting portion of said rearward end, said ring portion defining a bore having a generally circular inner surface having a first axis, said housing member terminating at its opposite end in a generally channel shaped portion extending generally transversely and forwardly inclined relative to said first axis and said rearward end, said channel portion having an inwardly extending shoulder portion proximate to the forward end of said base portion and pair of outer and inner stepped shoulder bores through said shoulder portion with the axis of said shoulder bores being coaxial with said first axis, said outer one of said shoulder bores being larger than said inner one of said shoulder bores, said channel portion terminating at its upper end in a portion extending generally in quadrature with said first axis, said upper end having a threaded anvil bore having a second axis which is radially offset from but parallel to said first axis, a rear adaptor member having a cylindrical portion with axially spaced radially extending shoulders rotatably located in said ring portion bore and having a bore defining a return cylinder cavity, the axis of said cylindrical portion including said return cylinder cavity being coaxial with said first axis, said adaptor member having an end portion extending rearwardly from said cylindrical portion and defining an enlarged stop shoulder engageable with the confronting end of said base ring portion to axially locate said cylindrical portion at a preselected position within said base ring portion, said adaptor member having a reduced diameter end bore extending through said adaptor end portion and, coaxially with said first axis from said return cylinder cavity, a piston comprising an annular piston head having a central bore and a piston rod slidably located in said piston head central bore, said piston rod extending coaxially with said first axis and having an enlarged head portion located in said enlarged shoulder bore and having a rod portion extending in clearance through said return cylinder cavity and generally in sliding engagement through said adaptor reduced diameter end bore, a collet member having a rearwardly extending piston portion slidably, rotatably located within said return cavity, said collet member having a first support bore extending generally coextensively with said collet piston portion and being slidably supported upon said rod portion of said piston rod, said collet member having an enlarged support bore at its opposite, forward end which is coaxial with said first support bore and with said enlarged support bore being slidably supported upon said piston head, an intermediate sized bore located between and connecting said first and second support bores and defining in part a pull cylinder cavity, said collet member having a forward portion extending transversely upwardly from and inclined relatively to said first axis and being contoured generally complementarily with the inner surface contour of said housing member channel portion, said collet member forward portion terminating at its upper end in a portion extending generally in quadrature to said first axis and having a jaw support bore located coaxially with said anvil bore along said second axis, said collet member adapted to reciprocate along said first and second axes rearwardly in response to fluid pressure applied to said pull cylinder cavity and forwardly in response to fluid pressure applied to said return cylinder cavity, said piston rod portion terminating at its rearward end in a threaded portion extending outwardly from said adaptor end bore, a threaded nut member matably threaded onto said piston rod threaded portion to clamp said enlarged stop shoulder of said adaptor member against said base ring portion, said piston rod portion having an axially extending fluid path and a first radial cross bore communicating said axial fluid path with said pull cylinder cavity, and a second radial cross bore located generally in said adaptor end portion, said adaptor member having first fluid path means communicating with said return cylinder cavity, said adaptor member having a second fluid path means communicating with said second cross bore and hence with said pull cylinder cavity via said axial fluid path and said first cross bore, fluid connecting means for connecting said first and second fluid path means to the source of fluid pressure and including a handle member, said housing member and said collet being selectively rotatable relative to said piston and about said first axis.

5. An installation tool selectively operable from a source of fluid pressure for setting multipieced fasteners by the application of a relative axial force between interacting fastener components, said installation tool comprising:

a housing member having a forward and a rearward end, said housing member having an elongated base portion terminating at its rearward end in a ring portion, said ring portion defining a bore having a generally circular inner surface having a first axis, said housing member terminating at its opposite end in a portion generally transversely to said first axis, said channel portion having an inwardly extending shoulder portion proximate to the forward end of said base portion and pair of outer and inner stepped shoulder bores through said shoulder portion with the axis of said shoulder bores being coaxial with said first axis, said outer one of said shoulder bores being larger than said inner one of said shoulder bores, said transverse portion terminating at its upper end in a portion having a first support bore having a second axis which is radially offset from but parallel to said first axis, a rear adaptor member having a cylindrical portion rotatably located in said ring portion bore and having a bore defining a return cylinder cavity, the axis of said cylindrical portion including said return cylinder cavity being coaxial with said first axis, said adaptor member having an end portion extending rearwardly from said cylindrical portion and defining an enlarged stop shoulder engageable with the confronting end of said base ring portion to axially locate said cylindrical portion at a preselected position within said base ring portion, a piston comprising a piston head a piston rod with said piston rod extending coaxially with said first axis, a collet member having a rearwardly extending piston portion slidably, rotatably located within said return cavity, said collet member having a first bore being slidably supported upon said piston, said collet member having a pull cylinder cavity operative with said piston head, said collet member having a forward portion extending transversely upwardly relatively to said first axis, said collet member forward portion terminating at its upper end with a second support bore located coaxially with said first support bore along said second axis, said collet member adapted to reciprocate along said first and second axes rearwardly in response to fluid pressure applied to said pull cylinder cavity and forwardly in response to fluid pressure applied to said return cylinder cavity, said piston rod terminating at its rearward end in a fastener portion extending outwardly from said adaptor end bore, a fastener member secured to said piston rod fastener portion to axially clamp said adaptor member relative to said base ring portion, first fluid path means in said piston communicating with said pull cylinder cavity, second fluid path means in said adaptor member communicating with said return cylinder cavity, fluid connecting means for connecting said first and second fluid path means to the source of fluid pressure, a nose assembly for installing the fastener in response to reciprocable movement of said collet member, said nose assembly including a first fastener setting member removably secured in said housing member first support bore, said nose assembly including a coacting assembly having a housing located within said collet second support bore and fastener means securing said coacting assembly to said collet, said housing member, said collet and said nose assembly being selectively rotatable relative to said piston and about said first axis.

6. An installation tool selectively operable from a source of fluid pressure for setting multipieced fasteners by the application of a relative axial force between interacting fastener components, said installation tool comprising:

a housing member having a forward and a rearward end, said housing member having an elongated base portion terminating at its rearward end in a ring portion, said ring portion defining a bore having a generally circular inner surface having a first axis, said housing member terminating at its opposite end in a forward portion extending relative to said first axis, said housing forward portion terminating at its upper end in a portion having an bore having a second axis which is radially offset from but parallel to said first axis, a rear adaptor member having a cylindrical portion rotatably located in said ring portion bore and having a bore defining a return cylinder cavity, the axis of said cylindrical portion including said return cylinder cavity being coaxial with said first axis, shoulder means on said adaptor member to axially locate said cylindrical portion at a preselected position within said base ring portion, a piston comprising an annular piston head and a piston rod, said piston rod extending coaxially with said first axis, a collet member having a rearwardly extending piston portion slidably, rotatably located within said return cavity, said collet member being slidably supported upon said piston, said collet member having a pull cylinder cavity operative with said piston head, said collet member having a forward portion extending transversely upwardly from said first axis, said collet member forward portion terminating at its upper end with a jaw support bore located coaxially with said anvil bore along said second axis, said collet member adapted to reciprocate along said first and second axes rearwardly in response to fluid pressure applied to said pull cylinder cavity and forwardly in response to fluid pressure applied to said return cylinder cavity, said piston rod terminating at its rearward end in a fastener portion, a fastener member secured to said piston rod fastener portion to clamp said shoulder means of said adaptor member relative to said base ring portion, first fluid path means in said piston for communicating with said pull cylinder cavity, second fluid path means for communicating with said return cylinder cavity, fluid connecting means for connecting said first and second fluid path means to the source of fluid pressure, a nose assembly for installing the fastener in response to reciprocable movement of said collet member, said nose assembly including an anvil member removably secured in said housing member anvil bore, said nose assembly including a jaw assembly having a housing located within and removably secured to said collet jaw bore, said housing member, said collet and said nose assembly being selectively rotatable relative to said piston and about said first axis.

7. An installation tool selectively operable from a source of fluid pressure for setting multipieced fasteners by the application of a relative axial force between interacting fastener components, said installation tool comprising:

a housing member having a forward and a rearward end, said housing member having an elongated base portion terminating at its rearward end in a ring portion, said ring portion defining a bore having a generally circular inner surface having a first axis, said housing member terminating at its opposite end in a forward portion extending generally transversely relative to said first axis, said housing forward portion terminating at its upper end in a portion having an anvil bore having a second axis which is radially offset from but parallel to said first axis, a rear adaptor member having a cylindrical portion rotatably located in said ring portion bore and having a bore defining a return cylinder cavity, the axis of said cylindrical portion including said return cylinder cavity being coaxial with said first axis, means on said adaptor member and said bore ring portion to axially locate said cylindrical portion at a preselected position within said base ring portion, a piston comprising an annular piston head and a piston rod, said piston rod extending coaxially with said first axis, support means on said housing and said rear adapter member for securing said piston rod from reciprocation relative to said housing and said rear adapter member, a collet member having a rearwardly extending piston portion slidably, rotatably located within said return cavity, said collet member being slidably supported upon said piston, said collet member having a pull cylinder cavity operative with said piston head, said collet member having a forward portion extending transversely upwardly from said first axis, said collet member forward portion terminating at its upper end with a jaw support bore located coaxially with said anvil bore along said second axis, said collet member adapted to reciprocate along said first and second axes rearwardly in response to fluid pressure applied to said pull cylinder cavity and forwardly in response to fluid pressure applied to said return cylinder cavity, first fluid path means for communicating with said pull cylinder cavity, second fluid path means for communicating with said return cylinder cavity, fluid connecting means for connecting said first and second fluid path means to the source of fluid pressure, a nose assembly for installing the fastener in response to reciprocable movement of said collet member, said nose assembly including an anvil member located in said housing member anvil bore, said nose assembly including a jaw assembly located within said collet jaw bore, said housing member, said collet and said nose assembly being selectively rotatable relative to said piston and to said cylindrical portion of said rear adaptor member and about said first axis for positioning said nose assembly relative to said first axis to accommodate fasteners to be set at different angular positions.

* * * * *